US010093006B2

(12) United States Patent
Lai

(10) Patent No.: US 10,093,006 B2
(45) Date of Patent: Oct. 9, 2018

(54) AUXILIARY DEVICE OF SCREWDRIVER

(71) Applicant: ROTE MATE INDUSTRY CO., LTD., Taichung (TW)

(72) Inventor: Ying-Tsung Lai, Taichung (TW)

(73) Assignee: ROTE MATE INDUSTRY CO., LTD., Taichung (TW)

( * ) Notice: Subject to any disclaimer, the term of this patent is extended or adjusted under 35 U.S.C. 154(b) by 102 days.

(21) Appl. No.: 15/238,680

(22) Filed: Aug. 16, 2016

(65) Prior Publication Data

US 2018/0050439 A1 Feb. 22, 2018

(51) Int. Cl.
*B25B 23/12* (2006.01)
*B25B 23/00* (2006.01)

(52) U.S. Cl.
CPC ..... *B25B 23/12* (2013.01); *B25B 23/0064* (2013.01)

(58) Field of Classification Search
CPC ..... B25B 23/12; B25B 23/0064
USPC ..... 81/456
See application file for complete search history.

(56) References Cited

U.S. PATENT DOCUMENTS 5,101,698 A 4/1992 Paradiso
5,673,887 A * 10/1997 Hollingsworth ..... A47F 5/0823 248/220.31
7,107,882 B1 * 9/2006 Chang ..... B25B 15/02 81/125
7,574,946 B1 * 8/2009 Chang ..... B25B 23/12 81/177.85
8,857,300 B2 10/2014 Lai
8,973,474 B2 3/2015 Lai
9,406,423 B1 * 8/2016 Tsai ..... B25B 23/02
9,566,695 B2 * 2/2017 Rajotte ..... B25B 23/0035
9,833,887 B1 * 12/2017 Liu ..... B25B 23/12
2016/0279769 A1 * 9/2016 Arslan ..... B25B 23/0064

FOREIGN PATENT DOCUMENTS

DE 1022230 1/1958
DE 102013110284 A1 3/2015

* cited by examiner

*Primary Examiner* — Hadi Shakeri
(74) *Attorney, Agent, or Firm* — Raymond Y. Chan; David and Raymond Patent Firm

(57) ABSTRACT

An auxiliary device of screwdriver refers to an auxiliary device attached on a screwdriver, which is adapted for keeping coupled on a recess close to an end of the screwdriver. The auxiliary device has an expanding portion and a hollow column formed by the extension of the expanding portion. An end of the expanding portion has a magnetic element arranged thereon. The hollow column is formed by connecting a plurality of ribs and walls. The inner margin of the hollow column extends to form a plurality of locking portions that allow the housing to couple with the screwdriver, wherein the auxiliary device is able to pivot on the screwdriver.

7 Claims, 9 Drawing Sheets

AUXILIARY DEVICE OF SCREWDRIVER

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The auxiliary device of screwdriver refers to an add-on structure arranged on a screwdriver. The screwdriver refers to a tool to drive nut bolts or screws. The auxiliary device comprises a magnetic element thereon to allow the screwdriver to automatically magnetically catch the head of the nut bolt, such that the screwdriver can stably attract and keep the head of the nut bolt in order to steadily drive the nut bolt.

Description of Related Arts

A prior conventional structure having the following patent numbers: DE1022230, DE102013110284, and U.S. Pat. No. 5,101,698, is an auxiliary device for a screwdriver to keep the position of the nut bolt, which is to set an auxiliary device on an end of the screwdriver and to use that auxiliary device to keep and clasp the nut bolt, so as to keep the head of the nut bolt in position on the driving end of the screwdriver. By such way of axis retaining, the position of the nut bolt can be kept when the screwdriver is axially rotating, which will not hinder the screwdriver from driving the nut bolt. However, the components of these prior structures are complex, which requires higher labor cost on the assembling. Besides, the patent of number U.S. Pat. No. 5,101,698 developed "Screw head depth limiter," which is a simple component that is able to limit the depth of the head of the nut bolt in reaching into the workpiece, but unable to provide the function of keep the position of the head of the nut bolt. In addition, FIGS. 8 and 9 show a prior invention of the present inventor. Referring to FIG. 8, a screwdriver 6' and a jacket 8 was disclosed. The screwdriver 6' is a rod 61' extending to form a driving portion 62', wherein there is a recess 63' set at where the rod 61' is close to the driving portion 62'. Also, the jacket 8 is a hollow cylinder which inner margin has a annular bearing rib 81. The axial section of the bearing rib 81 is a pyramid-shape that slightly slants oppositely. The jacket 8 is embedded on the recess 63' by means of the bearing rib 81. It has to be mentioned specifically that the jacket 8 has no expanding flexibility, so it requires mechanic pressure to push the jacket 8 onto the screwdriver 6' by constraint until the jacket 8 is pushed to the rod 61' of the screwdriver 6' and the bearing rib 81 is embedded on the recess 63'. Moreover, when the jacket 8 is sleeved on the screwdriver 6', it can not be taken off from the screwdriver 6' easily.

FIG. 9 discloses another implementation of the jacket 9. The inner margin of the jacket 9 further has a plurality of spaced and separated ribs 91. The rib 91 has a slope 92 that is triangular in a axially sectional view. The ribs 91 can help the jacket 9 to be pushed and sleeve onto the screwdriver smoothly.

Both of the above two types of jacket 8 and 9 do not have expanding and restoring flexible structure. In other words, both the jackets 8 and 9 require mechanic compelling force to be push onto the screwdriver 6' and the ribs 81 and 91 thereof make the pivoting of the jackets 8 and 9 on the screwdriver 6' unsmoothly.

SUMMARY OF THE PRESENT INVENTION

A main objective of the auxiliary device of screwdriver of the present invention is to provide a auxiliary device with a simplest structure that can be easily assembled on a screwdriver and taken away from the screwdriver, so as to achieve a reusable function for the auxiliary device.

The auxiliary device for the auxiliary device of screwdriver of the present invention refers to a structure attached on or added on a screwdriver. The screwdriver refers to a tool to drive nut bolts and screws, which comprises a rod extending an end thereof to form a driving portion, wherein there is a recess arranged at where the rod is close to the driving portion. Also, the auxiliary device is made with flexible material(s), such as rubber or plastics, and is sleeved on an end of the screwdriver and kept embedded on the recess. The auxiliary device has a hollow expanding portion. The expanding portion extends to form a hollow retaining portion. An end of the expanding portion has a magnetic element arranged thereon. The magnetic element is tight attached on the inner margin of the expanding portion. The outer margin of the retaining portion axially has a plurality of spaced ribs. The ribs have walls therebetween. The walls and ribs have valleys therebetween. The inner margin of the retaining portion extends to form a plurality of locking portions arranged in the opposite positions to the walls. Or in another words, the locking portions are arranged at the opposite internal side of the walls.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Figure 1:
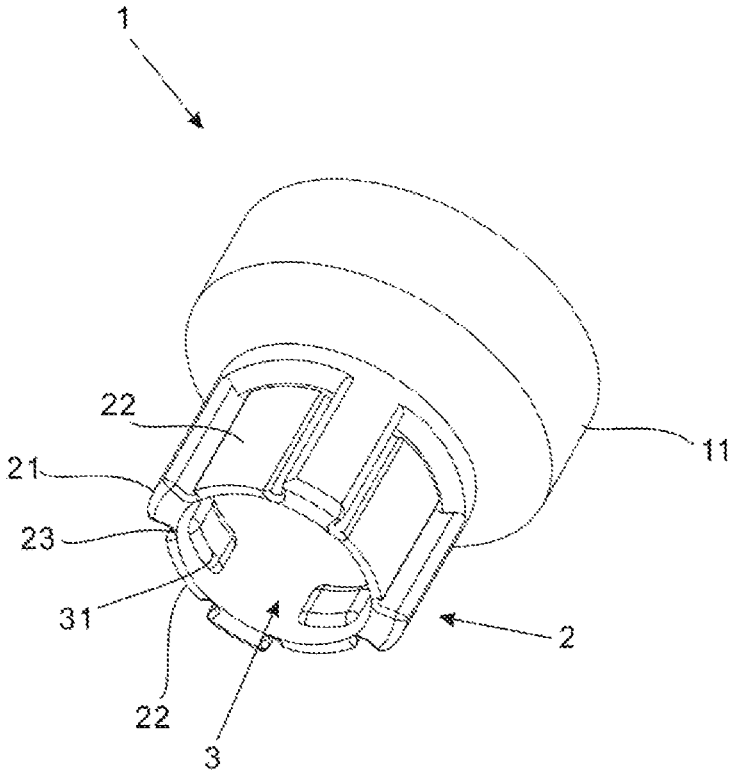
FIG. 1 is a 3D view of an auxiliary device according to the present invention.
Figure 2:
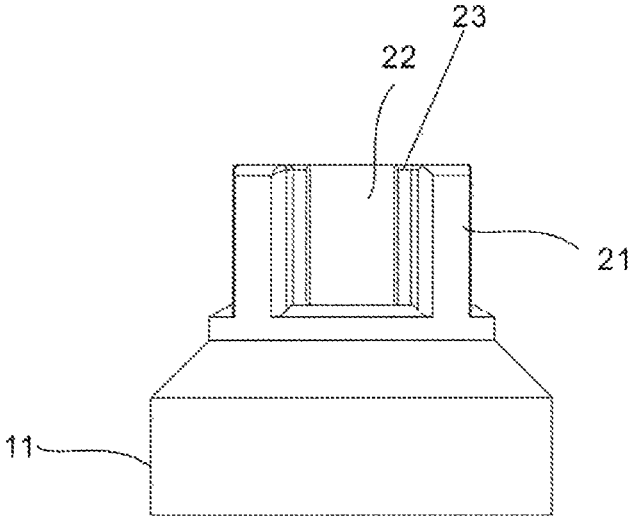
FIG. 2 is a side view of the above auxiliary device according to the present invention.
Figure 3:
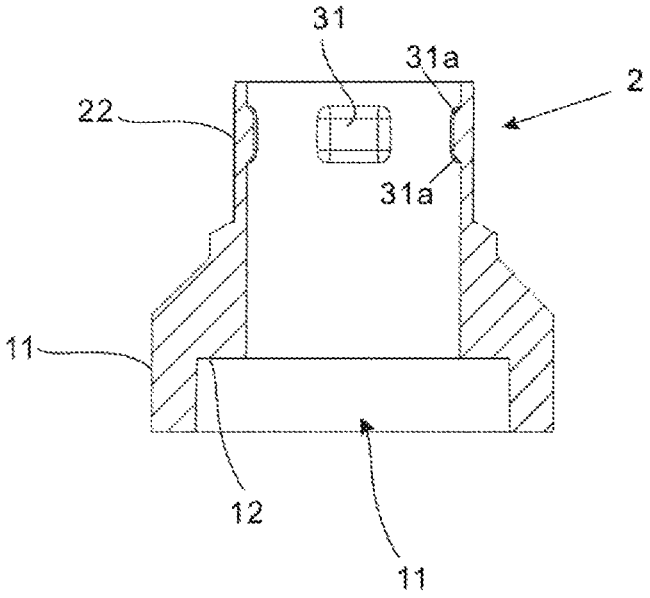
FIG. 3 is a side sectional view of the above auxiliary device according to the present invention.
Figure 4:
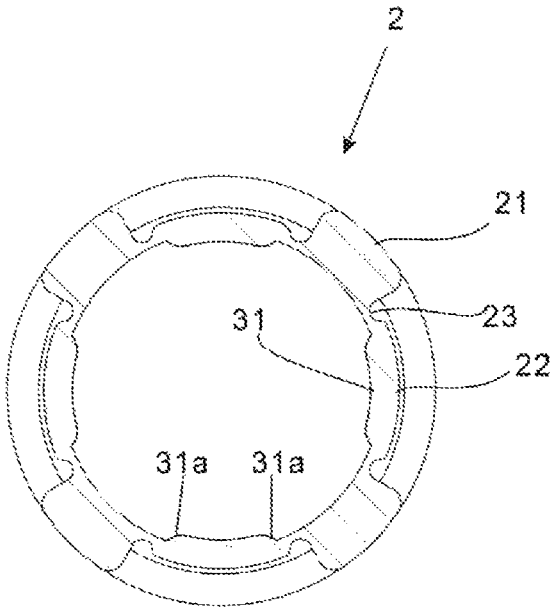
FIG. 4 is a top sectional view of the above auxiliary device according to the present invention.
Figure 5:
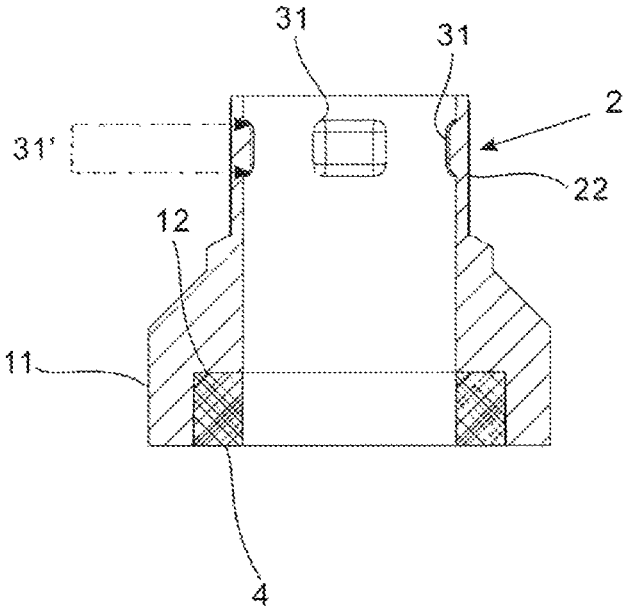
FIG. 5 is a side sectional view of the above auxiliary device according to the present invention illustrating an implementation.
Figure 6:
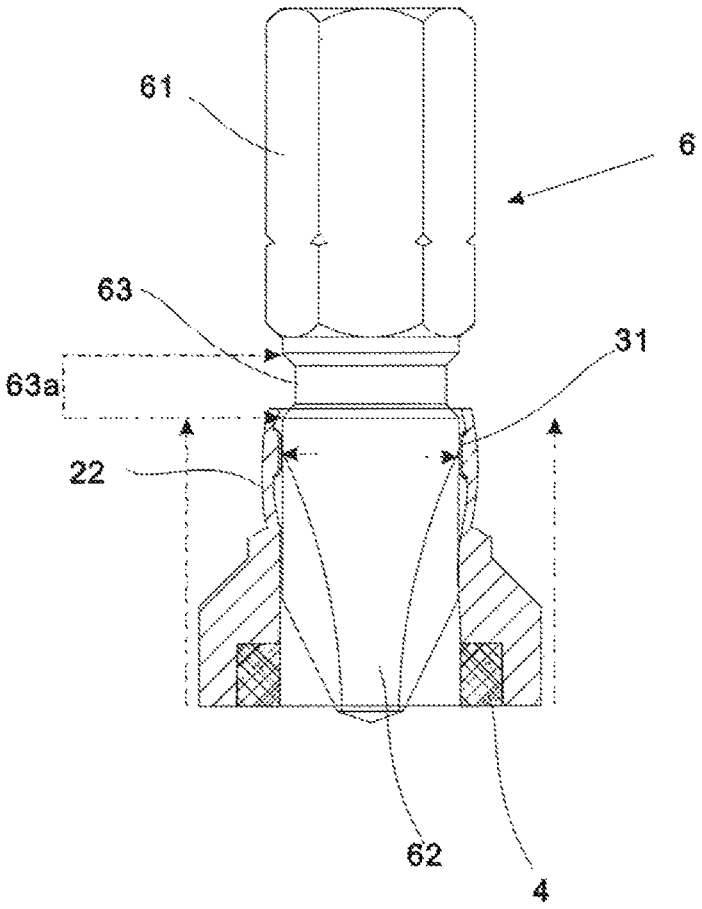
FIG. 6 is a side sectional view of the above auxiliary device according to the present invention illustrating the auxiliary device assembled on a screwdriver.
Figure 7:
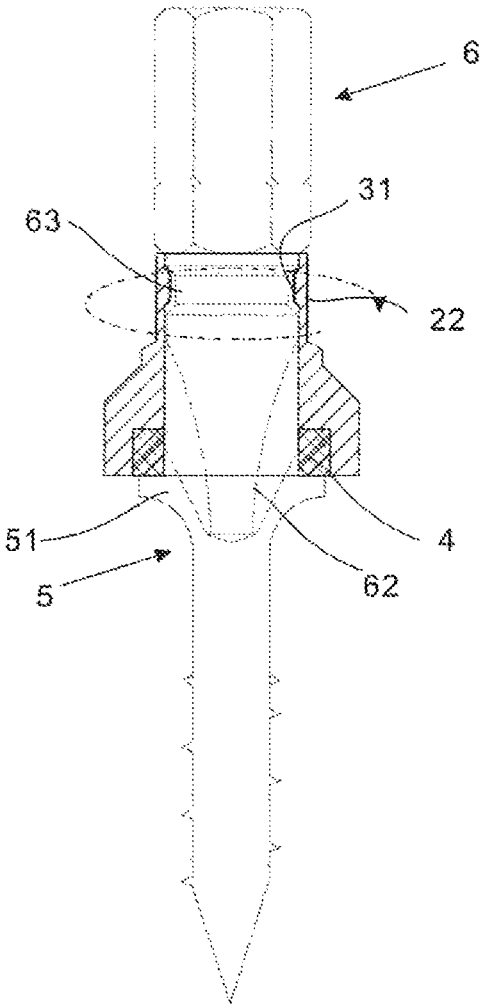
FIG. 7 is a perspective view of a screwdriver according to the present invention driving a nut bolt.
Figure 8:
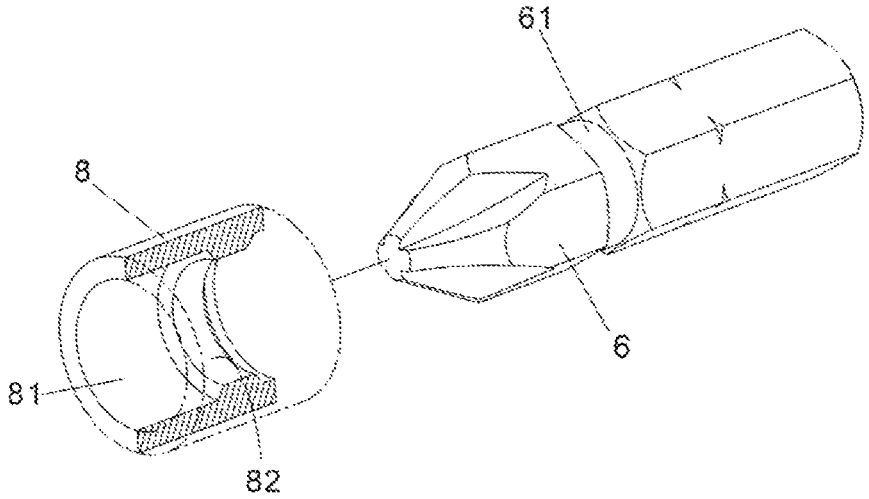
FIG. 8 (Prior Art)
FIG. 8 is a prior art about an exploded view of a conventional screwdriver and a conventional auxiliary device.
Figure 9:
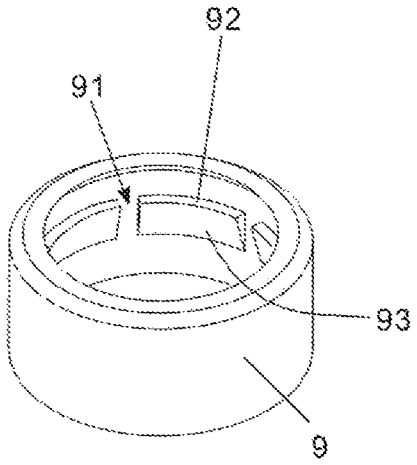
FIG. 9 (Prior Art)
FIG. 9 is a prior art about a 3D view of a conventional auxiliary device.

FIGS. 1-7 refers to the auxiliary device of screwdriver, wherein the screwdriver 6 is a rod 61 that extends an end thereof to form a driving portion 62 and has a recess 63 arranged around on the rod 61 close to said driving portion 62. The auxiliary device 1 is made of slightly flexible material(s), such as rubber or plastics. The auxiliary device 1 is arranged on an end of the screwdriver 6 and kept sleeving on the recess 63. The auxiliary device 1 has a hollow expanding portion 11 that extends to form a hollow retaining portion 2. The inner margin of the expanding portion has a catching groove 12. The catching groove 12 has a magnetic element 4, as shown in FIG. 5. The magnetic element 4 is externally put and tight secured on the expanding portion 11, wherein the way that the magnetic element 4 tight secured on the catching groove 12 can be with adhesives or other ways of locking. The outer margin of the retaining portion 2 has a plurality of ribs 21 axially spacedly arranged thereon. There are walls 22 axially arranged between the ribs 21. There are valleys 23 axially arranged between the walls 22 and the ribs 21. To define from another perspective, the ribs 21 extend and connect to form a wall 22 and the ribs 21 and the wall 22 form and connect a valley 23 therebetween, wherein a plurality of the ribs 21, the valley 23, and the wall 22 orderly aligning with one another to form the hollow retaining portion 2. The transverse thickness of the rib 21 is greater than the transverse thickness of the wall 22, while the transverse thickness of the valley 23 is smaller than the transverse thickness of the wall 22, as FIGS. 3 and 4 illustrated. The inner margin of the retaining portion 2 extends to form a plurality of locking portions 31, wherein the locking portions 31 are arranged at the opposite internal side. Besides, the end faces 31*a* of the locking portion 31 are arc faces, which means that every end face 31*a* is fillet, as FIGS. 3-5 illustrated. Such special design of the round end faces provides slippery function when the locking portions 31 are pushed on the rod 61 of the screwdriver 6 and helps the auxiliary device 1 to pivot on the recess 63 smoothly. On the other hand, such design on the auxiliary device 1 will not hinder the screwdriver 6 from driving the nut bolt 5 smoothly, as FIG. 7 illustrated.

FIG. 6 illustrates the way how the auxiliary device is assembled onto the screwdriver 6, wherein the auxiliary device 1 is sleeved onto the screwdriver 6 from the driving portion 62 thereof and axially pushed with external force to have the auxiliary device 1 keep sleeving forward on the driving portion 62. The locking portion 31 has slight expanding and restoring flexibility as the valley 23 provides the walls 22, so as to relatively support the locking portion 31 to have a push-to-hold function and slightly expand. As a result, the locking portion 31 slightly expands when it is on the outer margin side of the rod 61, which allows the auxiliary device 1 to be pushed to sleeve onto the rod 61 of the screwdriver 6 smoothly and moved all the way toward the recess 63. When the retaining portion 2 arrive the position of the recess 63, the walls 22 will draw back to the original state thereof, such that the locking portion 31 can lock or embed on the screwdriver 6 and allow the auxiliary device 1 to be pivotably retained on the screwdriver 6. Besides, the axial extent 63*a* of the recess 63 is slightly greater than the axial extent 31' of the locking portion 31. Therefore, the auxiliary device 1 can be axially slid in a limited distance on the recess 63 so as to be suitable for various sizes of nut bolts and ensure that the auxiliary device 1 can magnetically attractingly couple with the head 51 of the nut bolt and prevent it from dropping. Besides, it also mildly limits the depth of the head of the nut bolt 51 in reaching into the workpiece.

the present invention The shape of the screwdriver 6 of the present invention is only an example to provide a description and embodiment and shall not be a limit of the present invention. The auxiliary device 1 of the present invention may also be suitable for other driving tools.

All in all, the auxiliary device 1 has a function of catching the head 51 of the nut bolt 5 because of the magnetic element 4. The magnetic element 4 also allow the head 51 of the nut bolt 5 to separate from the auxiliary device 1 easily.

Especially, when the head 51 of the nut bolt 5 is locked into a workpiece, the screwdriver 6 will be limited and stopped from continuing drilling or reaching in when the bottom surface of the expanding portion 11 of the auxiliary device 1 attains the workpiece, such that the auxiliary device is able to prevent the surface of the workpiece from being damaged.

Features of the present invention include that the auxiliary device 1 is an integrally formed plastic structure, wherein the retaining portion 2 thereof has a plurality of ribs 21 extend and connect to form a wall 22, wherein the ribs 21 and the wall 22 form and connect a valley 23 therebetween, wherein a plurality of the ribs 21, the valley 23, and the wall 22 orderly aligning with one another to form the hollow retaining portion 2, which allows the wall 22 to have slight expanding flexibility. Such function of expansion makes the auxiliary device 1 be assembled on to the screwdriver 6 easily and relatively provides it a function of being taken away from the screwdriver with external force.

The above relates to specific embodiments of the present invention, which are for description purposes. Several extensions and modifications can also be made without being apart from the spirit of the present invention.

The public embodiments are to describe in all approaches, rather than to limit the present invention. The scope of the present invention is pointed out in the appended claims instead of the above descriptions. Besides, all changes within the equivalent framework and scope of the present invention are all included based on the appended claim.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. An auxiliary device of screwdriver, which is an auxiliary device added on a screwdriver, wherein said screwdriver is a rod extending an end thereof to form a driving portion, wherein said screwdriver has a recess arranged around on said rod close to said driving portion, wherein said auxiliary device is arranged on an end of said screwdriver and kept sleeving on said recess, wherein said auxiliary device comprises an expanding portion, having a hollow accommodating space that has a catching groove therein that has a magnetic element put and tight secured in said expanding portion, and a retaining portion formed by extending said expanding portion, having a hollow accommodating space which outer margin has a plurality of spacedly arranged and axially extending ribs, a plurality of walls axially extending and connecting between said ribs, and a plurality of axially extending valleys between said walls and said ribs, wherein the transverse thickness of said rib is greater than the transverse thickness of said wall, while the transverse thickness of said valley is smaller than the transverse thickness of said wall, wherein said retaining portion has an inner margin, wherein the inner margin of said retaining portion extends to form a plurality of opposite locking portions, wherein said locking portions are arranged at the opposite positions to the walls, wherein each said locking portion has end faces that are arc faces.

2. The auxiliary device of screwdriver, as recited in claim 1, made with slightly flexible material(s), comprising rubber and plastics.

3. An auxiliary device of screwdriver, referring to a device to be assembled on a screwdriver to assist for screw driving and alignment, wherein said screwdriver has a driving portion arranged thereon and a recess arranged around on said screwdriver and close to said driving portion, wherein said auxiliary device is arranged on an end of said screwdriver and kept sleeving on said recess, wherein said auxiliary device comprises: an expanding portion, which is a hollow annular structure having an inner margin and a catching groove on the inner margin thereof, wherein said catching groove has a magnetic element put and tight secured in said expanding portion; and a retaining portion, which is a hollow column formed by extending said expanding portion and has a plurality of axially extending ribs spacedly arranged on an exterior surface thereof, an axially extending wall extended and connected between said ribs, and an axially extending valley extended and formed between said walls and said ribs, wherein said hollow column shaped retaining portion is defined and formed by a plurality of said ribs, said valley, and said wall orderly aligning, extending, and connecting with one another, wherein the transverse thickness of said rib is greater than the transverse thickness of said wall, while the transverse thickness of said valley is smaller than the transverse thickness of said wall, wherein said retaining portion has an inner margin, wherein the inner margin of said retaining portion extends to form a plurality of locking portions, wherein said locking portions are arranged at the opposite positions to the walls, wherein each said locking portion has four end faces that are all round.

4. The auxiliary device of screwdriver, as recited in claim 3, made with flexible material(s), comprising rubber and plastics.

5. An auxiliary device of screwdriver, referring to a device to be assembled on a screwdriver to assist for screw driving and alignment, wherein said screwdriver has a driving portion and has a recess arranged around on said screwdriver and close to said driving portion, wherein said auxiliary device is arranged on an end of said screwdriver and kept sleeving on said recess, wherein said auxiliary device has a hollow expanding portion and a hollow retaining portion formed by extending said expanding portion, wherein said expanding portion has an inner margin and a catching groove arranged on the inner margin thereof, wherein said catching groove has a magnetic element put and tight secured on said expanding portion, wherein an exterior surface of said retaining portion has a plurality of axially extending ribs spacedly arranged thereon, wherein said ribs extend and connect to form an axially extending wall and said ribs and said wall connect and form an axially extending valley therebetween, wherein said plurality of ribs, said valley, and said wall orderly aligning with one another to form said hollow retaining portion, wherein the transverse thickness of said rib is greater than the transverse thickness of said wall, while the transverse thickness of said valley is smaller than the transverse thickness of said wall, wherein said retaining portion has an inner margin, wherein the inner margin of said retaining portion extends to form a plurality of locking portions, wherein said locking portions are arranged at the opposite internal side of the walls.

6. The auxiliary device of screwdriver, as recited in claim 5, wherein each said locking portion has end faces that are arc faced, which means that every said end face is fillet.

7. The auxiliary device of screwdriver, as recited in claim 5, made with flexible material(s), comprising rubber and plastics.

* * * * *